US006419750B1

(12) United States Patent
Tabak et al.

(10) Patent No.: US 6,419,750 B1
(45) Date of Patent: Jul. 16, 2002

(54) APPARATUS AND METHODS FOR DISPENSING FLUID

(75) Inventors: John Tabak, Ravenstein; Hendrik-Jan Righolt, Oosterhout, both of (NL)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/564,512

(22) Filed: May 4, 2000

(30) Foreign Application Priority Data

May 5, 1999 (DE) ..... 299 07 968

(51) Int. Cl.[7] ..... B05C 5/02

(52) U.S. Cl. ..... 118/684; 118/302; 118/313; 427/207.1; 427/422

(58) Field of Search ..... 118/684, 302, 118/313; 427/207.1, 422; 222/504, 146.5; 156/578, 363, 575; 239/128, 135, 133, 296

(56) References Cited

U.S. PATENT DOCUMENTS

| | | | | |
|---|---|---|---|---|
| 3,840,158 A | | 10/1974 | Baker et al. | 222/487 |
| 4,729,908 A | * | 3/1988 | Mahrle | 118/313 |
| 6,216,760 B1 | * | 4/2001 | D'Aguiar | 156/363 |

FOREIGN PATENT DOCUMENTS

| | | |
|---|---|---|
| DE | 2349268 C2 | 4/1974 |
| DE | 4013322 A1 | 10/1991 |
| DE | 4302370 C1 | 1/1993 |

* cited by examiner

*Primary Examiner*—Laura Edwards
(74) *Attorney, Agent, or Firm*—Wood, Herron & Evans, L.L.P.

(57) ABSTRACT

Device for dispensing fluid, especially glue, with a main body and several application modules attached to the main body, each of which has a fluid canal which can be connected to a source of fluid and ends in an output orifice, as well as an application valve for optional interruption and release of the flow of fluid. At least one application module has an electrically operable application valve and at least one application module has a pneumatically operable application valve.

9 Claims, 6 Drawing Sheets

APPARATUS AND METHODS FOR DISPENSING FLUID

This application claims the priority of German Utility Model No. 29907968.6 filed May 5, 1999, the disclosure of which is hereby fully incorporated by reference herein.

FIELD OF THE INVENTION

The present invention pertains to a device for dispensing fluid, especially glue, having a main body and multiple application modules attached to the main body.

BACKGROUND OF THE INVENTION

Devices for dispensing and applying fluids, such as hot-melt adhesive or glue, are used in various branches of industry. The glue is provided from a glue source, such as a reservoir filled with glue, to multiple application modules mounted on the main body, for example, side by side in a row. Each application module has an individually controllable application valve, so that glue can be applied as needed and in accordance with a desired application pattern onto a substrate moving relative to the device. Glue is applied using such devices to substrates including a film or a packaging material such as cardboard.

In one known device, multiple application modules are attached adjacently on the main body. The application modules are provided glue from a shared fluid supply canal and the application valves are operated pneumatically with pressurized air.

SUMMARY OF THE INVENTION

The task of the present invention is to improve the versatility and flexibility of a fluid dispensing device having multiple dispensing modules attached to a single main body.

According to the invention, the fluid dispensing device is provided with at least one application module having an electrically operable application valve and at least one application module having a pneumatically operable application valve. The application modules can be utilized simultaneously or alternately, depending upon the use and need, to provide significant versatility. Thus, for example, cold glues and/or hot-melt glues can be applied with the device in accordance with the invention. The main body has at least two separate fluid supply canals, each of which can be connected to a source of fluid, for supplying fluid to the application modules.

According to the invention, two or more different fluids can be supplied in different ones of the separate fluid supply canals. The fluids flowing through the separate fluid supply canals can be applied with different pressures or different temperatures, and may be applied with application modules having either electrically operable application valves or pneumatically operable application valves. The device can be adapted easily for the respective use. In accordance with the invention, several application modules can be supplied with a first fluid through a first fluid supply canal and several additional application modules can be supplied with a different fluid through a different fluid supply canal. One of the separate fluid supply canals may be temporarily not used and deactivated. Therefore, the device according to the invention allows a high measure of flexibility and varied usage.

In a preferred embodiment of the invention, connections on the face of the main body communicate with the fluid supply canals and the fluid supply canals extend in the direction of a longitudinal axis of the main body. A fluid line may be connected to each connection. In this way a large number of application modules can be attached to the main body and supplied with fluid, such as adhesive or glue, through the separate fluid canals. Placing the connections on the face of the main body permits a compact design.

According to a further aspect of the invention, the main body may have a mounting surface which is substantially perpendicular to the face and to which the application modules are attached. The mounting surface includes fluid holes communicating with the fluid supply canals for introducing fluid into the application modules. On the mounting surface, which is planar, threaded holes are provided for attaching the application modules. All of the application modules can be attached to the mounting surface in immediate proximity to each other, or individual modules may be spaced apart, in which case attachment sections for modules are unused and fluid inlet holes in these sections are sealed with plugs or the like. In this manner, the device can be adapted to special uses.

In an embodiment of the invention, at least one electrical connection is located on the face of the main body and electrical lines extend inside of the main body from the connection to the electrically operable application valves in order to be able to control the latter. Providing electrical connections on the face of the main body and lines that lead to the electrically operable application valves eases assembly of the device. The individual components of the device are assembled in a simple manner.

In another embodiment of the invention, the flexibility, compactness and simple assembly of the device are further enhanced by providing the main body with a pressurized gas connection and an integrated canal or canal system for controlling the pneumatically operable application valves.

For uses in which for example hot-melt glue or other fluids which need to be heated or warmed are to be applied, the main body may have an integrated electrical heater and the connector for the electric heater may be located on the face of the main body. As a result, an electrical supply line can be linked to the connection simply and quickly.

In an additional aspect of the invention, a guide unit may be provided near the output openings of the application modules. The guide unit is used to direct a substrate moving relative to the device along a defined path. The guide unit has several guide elements which can be fixed on an attaching rail in various positions relative to the output orifices of the application modules, so that the guide elements can also be adapted easily and quickly to the particular use. The attaching rail may be affixed to the main body by a holding element mounted on the face of the main body.

BRIEF DESCRIPTION OF THE DRAWINGS

Various additional features, objects and advantages will be readily recognized upon further review of the exemplary embodiments. The invention is described below on the basis of exemplary embodiments with reference to the attached drawings.

DETAILED DESCRIPTION OF THE PREFERRED EMBODIMENT

Figure 1:
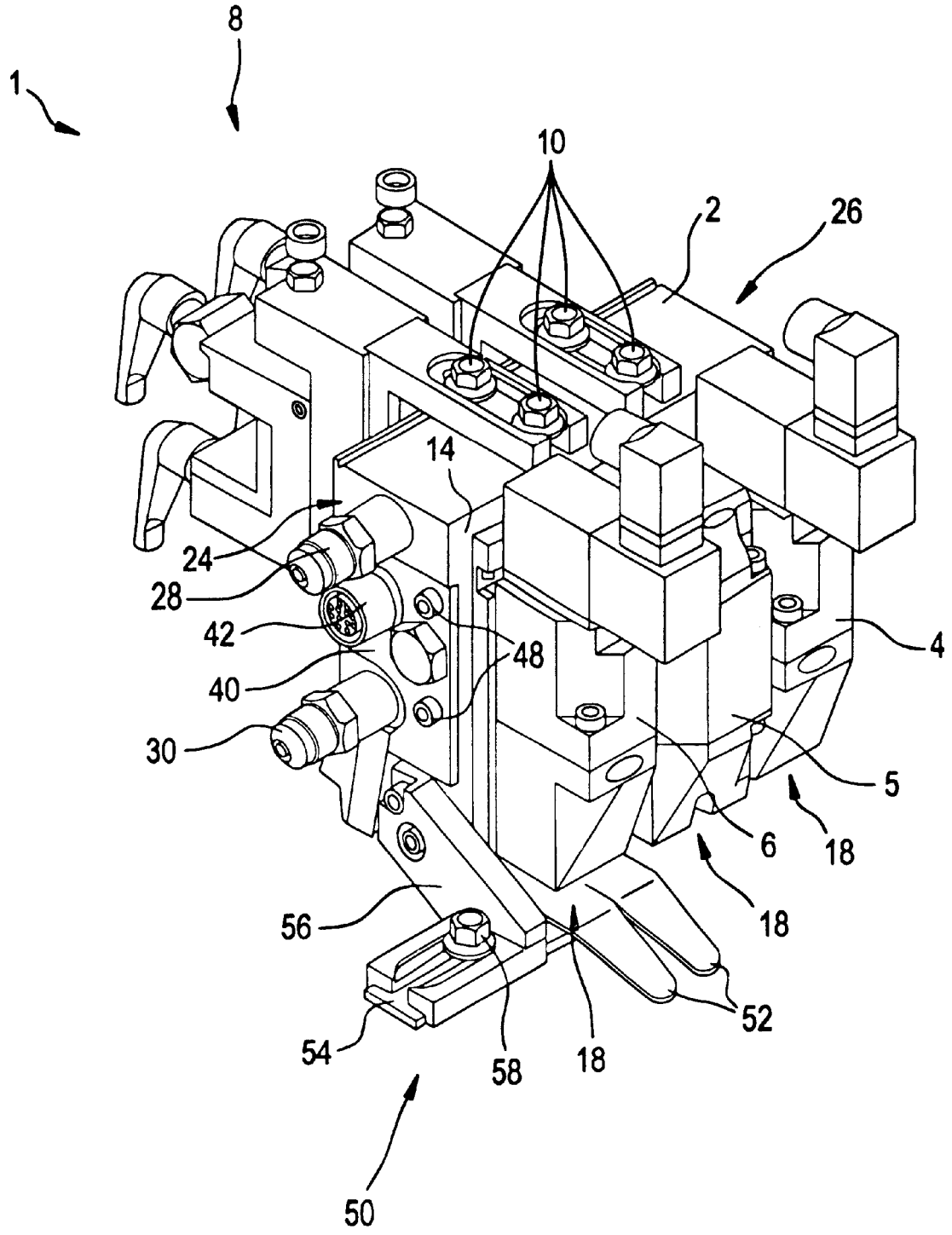
FIG. 1 is a perspective view of a device in accordance with the invention for dispensing and applying glue.

A device 1, shown in FIG. 1 in perspective view, for dispensing and applying glue onto a substrate, which can be moved relative to the device 1. The device 1 has a main body 2 and three application modules 4, 5, 6 attached to the main body 2. The main body 2 is depicted separately in FIGS. 2 and 3. A clamping device 8 is detachably bolted to the main body 2 with the help of a number of bolts 10, each of which is screwed into a threaded hole 12 in the main body 2, and serves to attach the device 1 to a frame (not shown) of a production facility or of a machine. In an alternative manner, not shown, a larger number of application modules can be attached to the main body 2, which is then lengthened.

Each application module 4, 5, 6 is screwed to a flat mounting surface 14 (see FIG. 2) on the main body 2. For this purpose, there are a number of threaded holes 16 on the main body 2, into which bolts (not shown) are screwed in order to affix the application modules 4, 5, 6. Each application module 4, 5, 6 has, in a known manner, an inner fluid canal (not shown), which can be connected to a fluid source (not shown) and which ends in an output orifice 18. Inserted into each of these fluid canals is an application valve (not shown), for example in the form of a needle valve, which has a valve seat and a movable needle.

The two outer application modules 4, 6 each have a pneumatically operable application valve (not shown), that is, a movable valve body (for example the needle of a needle valve) that can be moved with the help of pressurized gas from an open to a closed position and vice versa in order to interrupt or release the flow of glue. Each pneumatically operable application valve includes, for example, a piston which moves in a cylinder. The piston is linked to the valve body and can be subjected to various gas pressures so that it moves within the cylinder. The middle application module 5 has an electrically operable application valve (not shown), in which a movable valve body moves relative to a valve seat between an open and a closed position with the help of an electromagnet.

Figure 3:
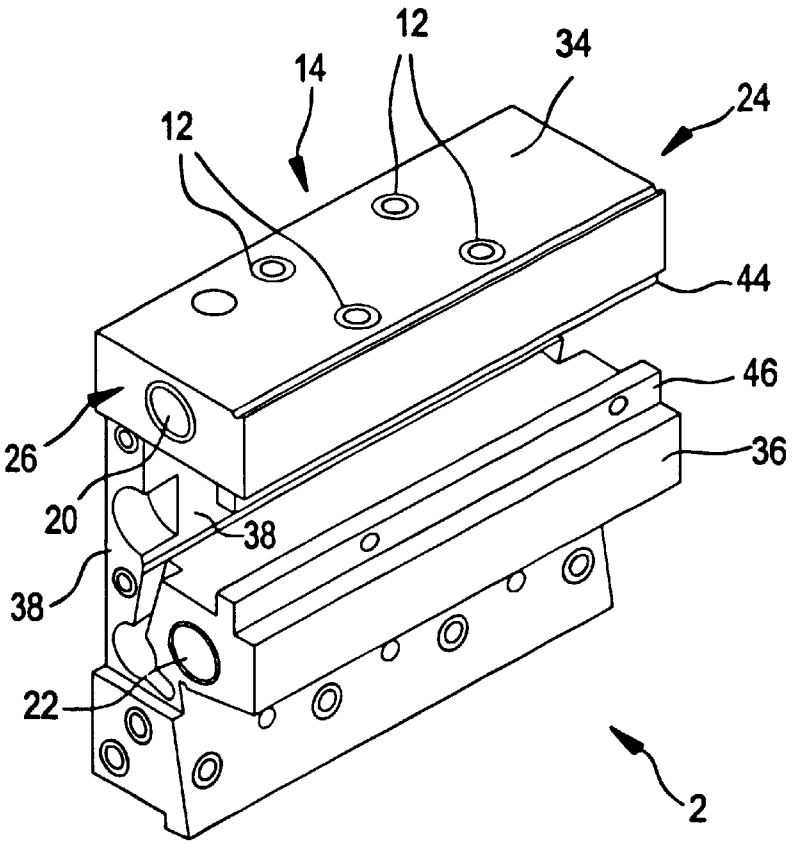
FIG. 3 is an additional perspective view of the main body shown in FIG. 2.
Figure 2:
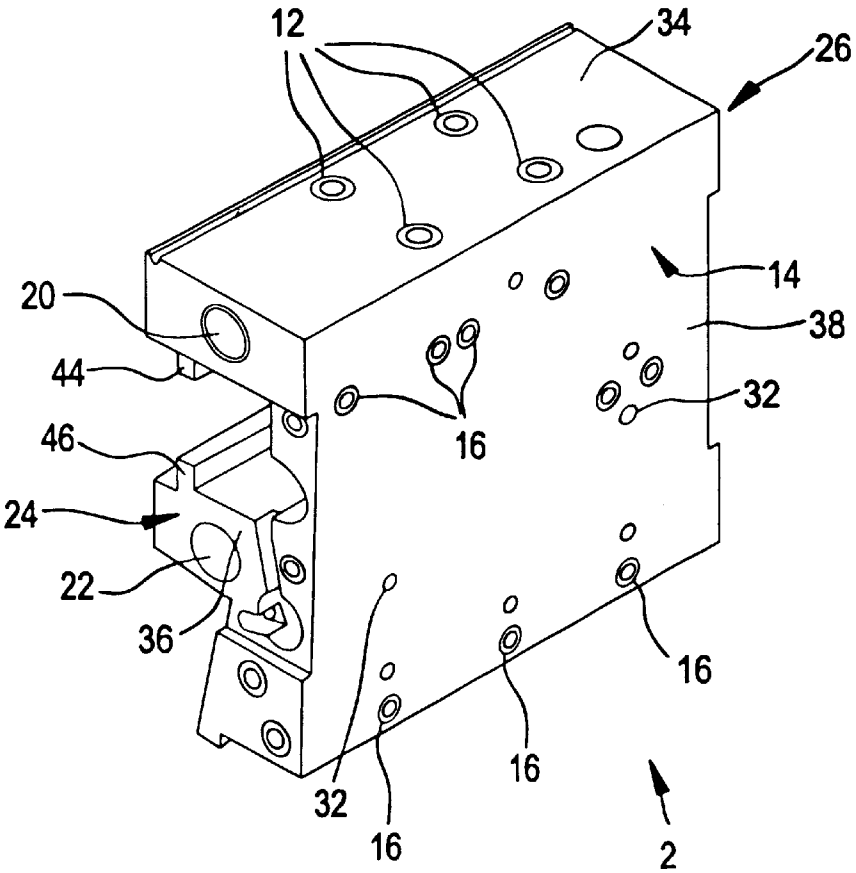
FIG. 2 is a perspective view of a main body that provides a distribution block for the device shown in FIG. 1.

In the metal main body 2, as FIGS. 2 and 3 illustrate clearly, two fluid supply canals 20, 22 extend essentially along a longitudinal axis of the main body 2 between a front face 24 and a rear face 26. In the area of the faces 24, 26, the fluid supply canals 20, 22 have a female thread into which, as illustrated in FIG. 1, either hydraulic connections 28, 30 or plugs for closing the fluid supply canal 20, 22 on the opposite rear face 26 can be screwed. Attached to the hydraulic connections 28, 30 during operation are fluid lines (not shown), for example hoses, which are connected to a source of fluid, such as a reservoir for liquid glue. In FIG. 1, in the area of the rear face 26, plugs (not shown) are screwed in to close the fluid supply canals 20, 22.

In the main body 2, bored fluid holes 32 extend substantially perpendicular to the mounting surface 14 for introducing fluid into the application modules 4, 5, 6. Each fluid hole 32 communicates between one of the fluid supply canals 20, 22 and one of the fluid canals of the application modules 4, 5, 6. The fluid supply canals 20, 22 and the fluid holes 32 are formed in respective longitudinal sections 34, 36, which are substantially parallel to and at some distance from each other and which are connected with each other by a connecting section 38.

In the assembled state, as FIG. 1 shows, an insert 40 is placed between the two sections 34, 36 of the main body 2. The insert 40 has an electrical connector 42 in the area of the front face 24 of the main body 2, as well as electrical lines (not shown) which run mainly inside of the main body 2 and which produce an electrical connection between the connector 42 and the electrically operable application valve of the application module 5. Application valve 5 or, in an alternative embodiment with several electrically operable application valves, multiple application modules 5 can be actuated using the electrical lines. The insert 40 is held to the main body 2 with the help of two protrusions 44 and 46 (FIGS. 2 and 3) formed on the sections 34 and 36, respectively, and is secured to the main body 2 with screws 48 (see FIG. 1). The protrusions 44, 46 extend in the longitudinal direction of the main body 2.

With reference to FIG. 1, a guide unit 50 guides a substrate (not shown) moving relative to the device along a defined path. The guide unit 50 permits a substrate, such as cardboard or film, to be guided past the output orifices 18 of the application modules 4, 5, 6 in such a way that an optimal application of glue is achieved. The guide unit 50 has several tongue-shaped and partially curved guide elements 52. In the illustrated variant, a pair of guide elements 52 are arranged on an attaching rail 54 and each element 52 can be fixed in various positions relative to the output orifices 18 of the application modules 4, 5, 6. Thus, the attaching rail 54 can be shifted in the longitudinal direction relative to a holding element 56, which is affixed to the face 24 of the main body 2, and can be fixed in various positions with the help of a screw 58. Alternatively, the attaching rail 54 can have a greater length than that shown and several guide elements 52 may be positioned on the attaching rail 54. Particularly, if more than three application modules 4, 5, 6 are provided side by side in a row on a main body, the attaching rail 54 can be of a length which corresponds substantially to the length of the main body 2.

Although not illustrated, an additional connection may be provided on the main body 2 for connecting a pressurized gas line to an internal canal in the main body 2 and delivering a pressurized gas. The pneumatically operable application valves of the application modules 4, 6 can be controlled using the pressurized gas. In this case, it would also be preferable to have the pressurized gas connection on the face 24 of the main body 2 communicate via the pressurized gas canal to the mounting surface 14. The application modules 4, 6 with the pneumatically operable application valves each have a pressurized gas canal which communicates and seals in the area of the mounting surface 14 with the pressurized gas canal in the main body 2.

In accordance with an aspect of the invention, an electric heater (not shown) may be integrated into the main body 2 and a corresponding electrical connection (not shown) for the electrical heater provided, preferably, on the face 24 or 26. The electric heater may be switched on if a hot-melt glue is to be applied with the help of the device 1.

Figure 4:
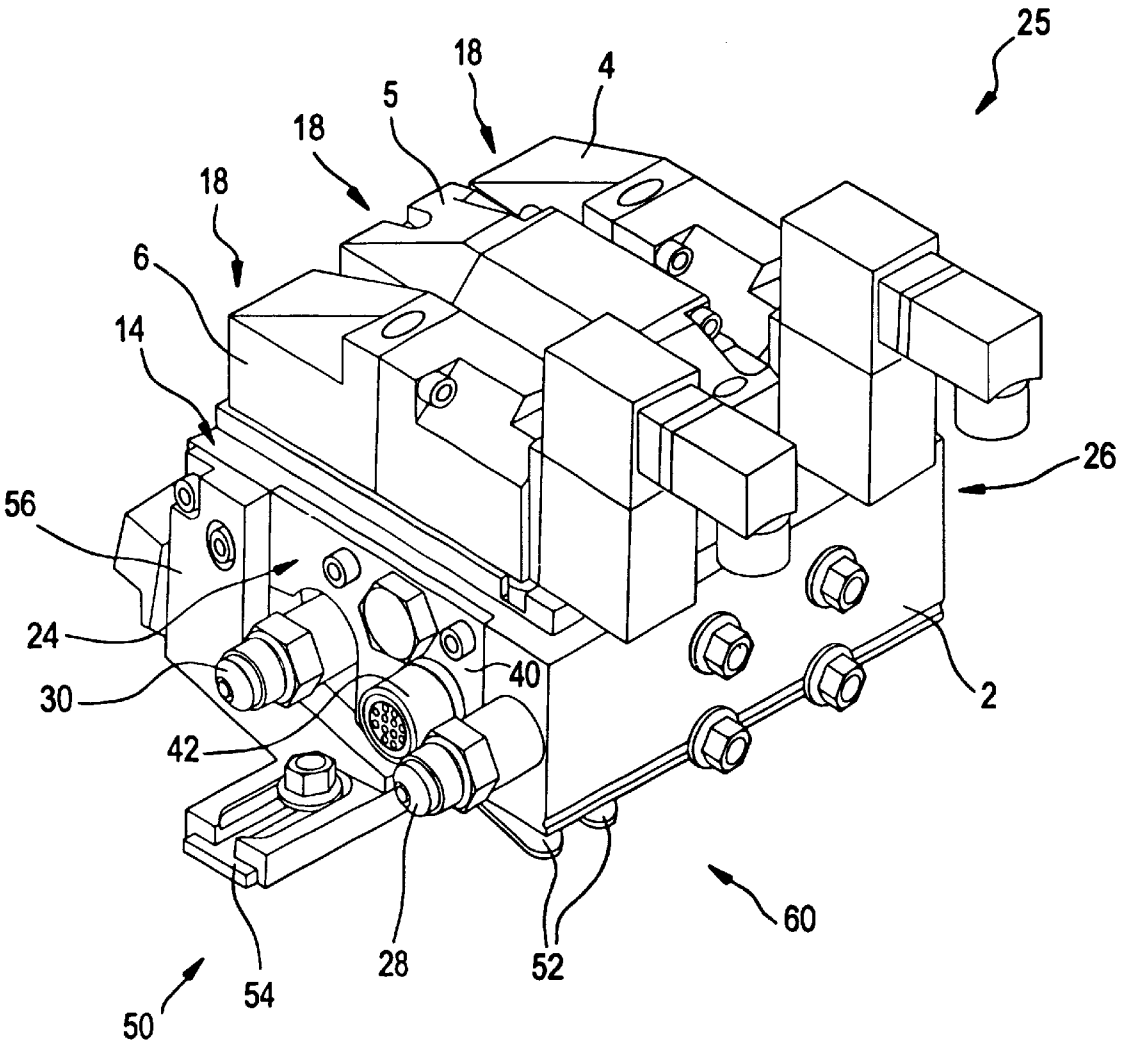
FIG. 4 is a perspective view of an alternative embodiment of a device in accordance with the invention.

An alternative embodiment of a device 25 for dispensing glue is illustrated in FIG. 4. Similar to device 1 described in detail above, device 25 has a main body 2 and three application modules 4, 5, 6 attached thereto. Since this embodiment has many points in common with the embodiment described above in FIGS. 1–3, equivalent parts are given the same reference symbols, and reference is made to the previous description with respect to equivalent parts in order to avoid repetitions. The application modules 4, 6 have pneumatically operable application valves and the application module 5 has an electrically operable application valve. On the face 24 of the main body 2, hydraulic connections 28, 30 communicate with the fluid supply canals 20 and 22, respectively, formed in the main body 2. An electrical connection 42 is linked with electric lines (not shown) which run in the interior of the main body 2, and which serve to control the electrically operable application valve of the application module 5.

The guide unit 50 has two partially visible guide elements 52 and an attaching rail 54, which is affixed to the main body 2 by a holding element 56. In the embodiment shown in FIG. 4, a substrate to which glue is to be applied is moved past underneath the main body 2 in the direction of the arrow 60 and glue flowing from the output orifices 18 is applied to it.

Figure 5:
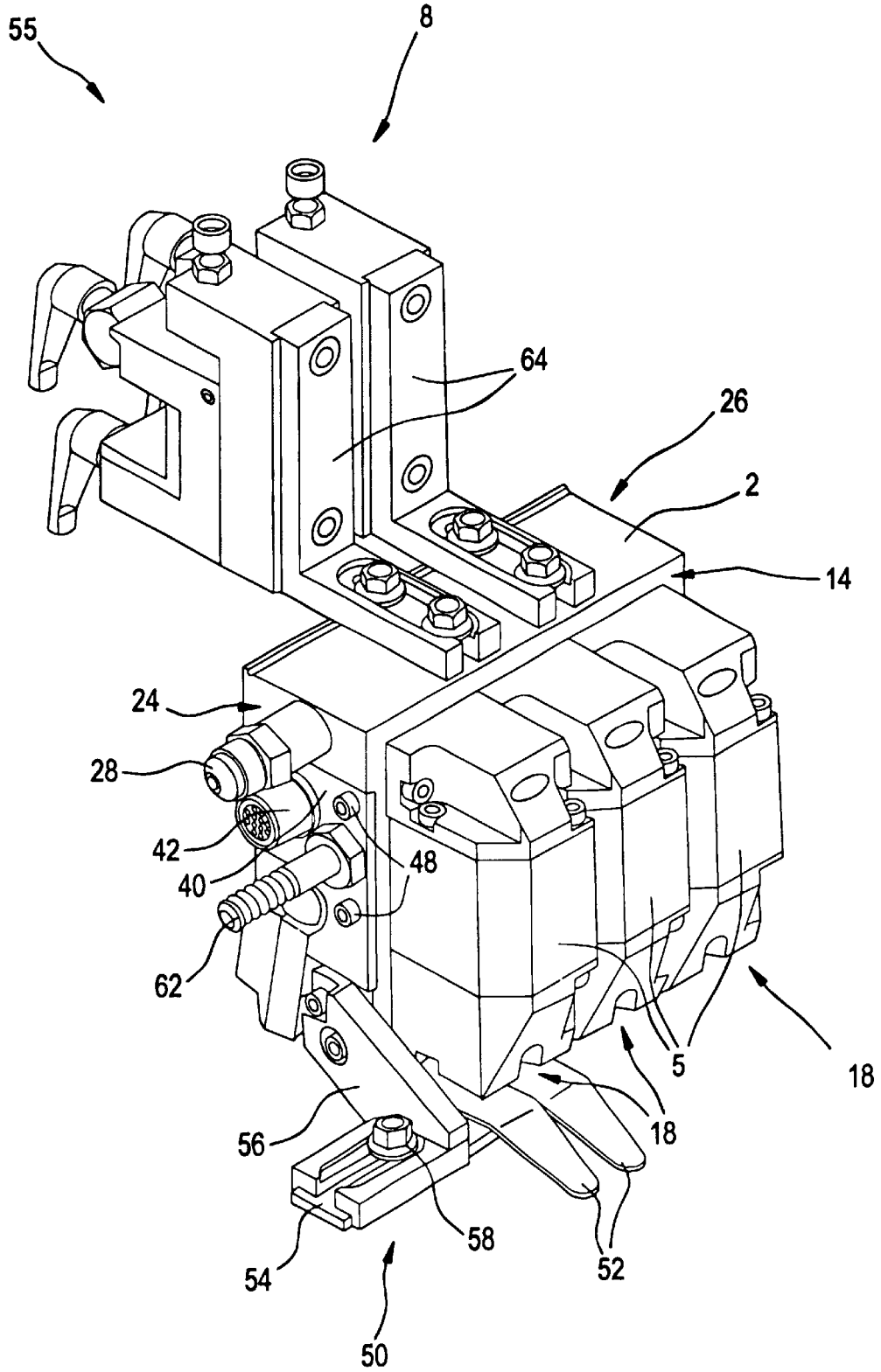
FIG. 5 is a perspective view of another alternative embodiment of a device in accordance with the invention.

FIG. 5 shows another alternative embodiment of a device 55 in accordance with the invention for dispensing glue in which three electrically operable application modules 5 are attached to a main body 2. Equivalent parts have the same reference symbols as in the description above. By means of a hydraulic connection 28, glue is introduced into the main body 2 and into the application modules 5. With the help of an electrical connection 42, the electrically operable application valves of the application modules 5 can be controlled individually. In addition, this embodiment has an electric heater inside the main body 2, integrated into an insert 40, which is supplied with electrical energy by means of an additional electrical connection 62. The guide unit 50 is positioned beneath the output orifices 18 of the application modules 5 as described above with regard to FIG. 1.

Mounted on the top of the main body 2 is a clamping device 8. Device 55 is detachably affixed with clamping device 8 to the frame (not shown) of a production facility or of a machine.

Figure 6:
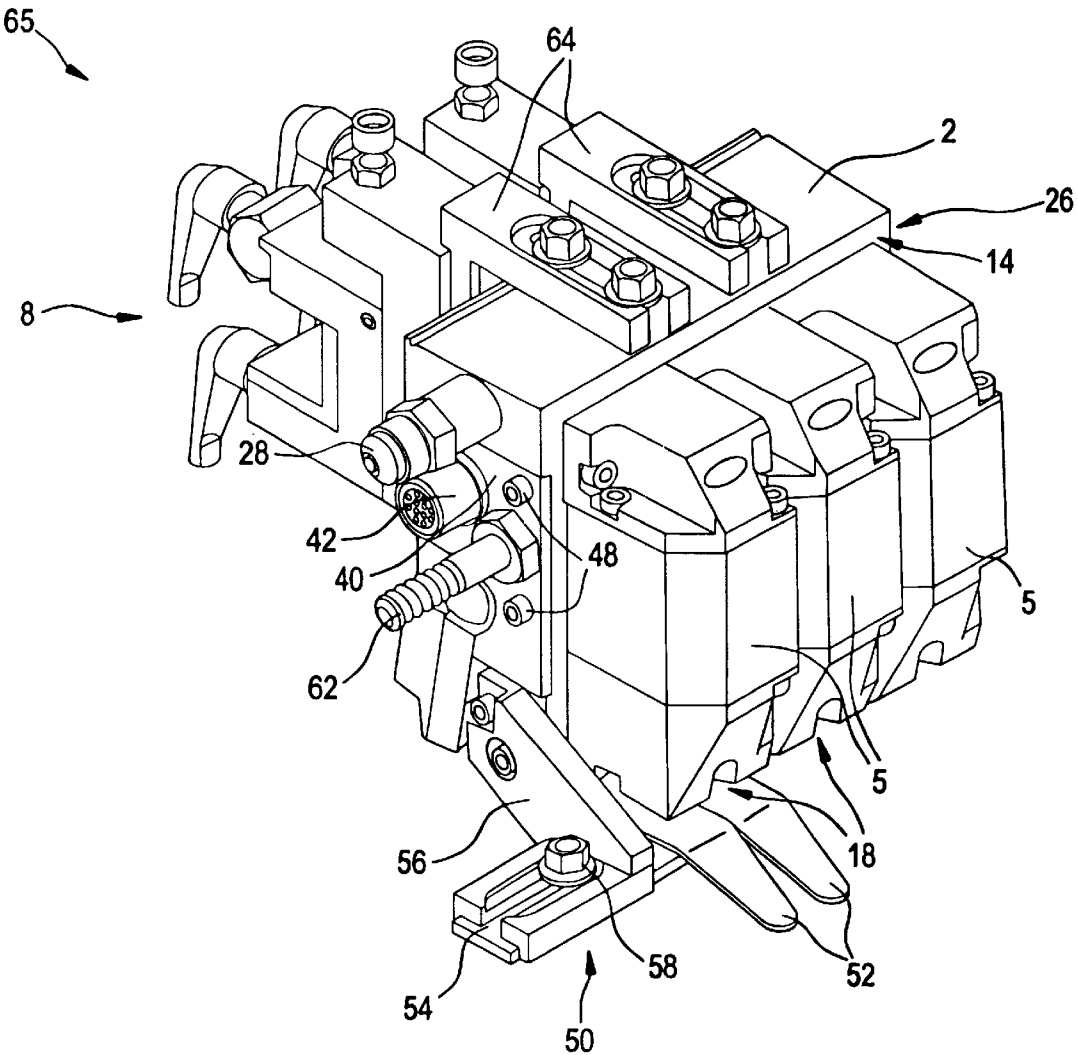
FIG. 6 is a perspective view of another alternative embodiment of a device in accordance with the invention.

Two angle pieces 64 have one leg bolted to the main body 2 and another leg attached to the clamping device 8. The device 55 shown in FIG. 6 differs from device 25 shown in FIG. 5 only in that the clamping device 8 is attached in a different manner to the main body 2, specifically, with angle pieces 64, so that a lower overall construction height is achieved.

Figure 7:
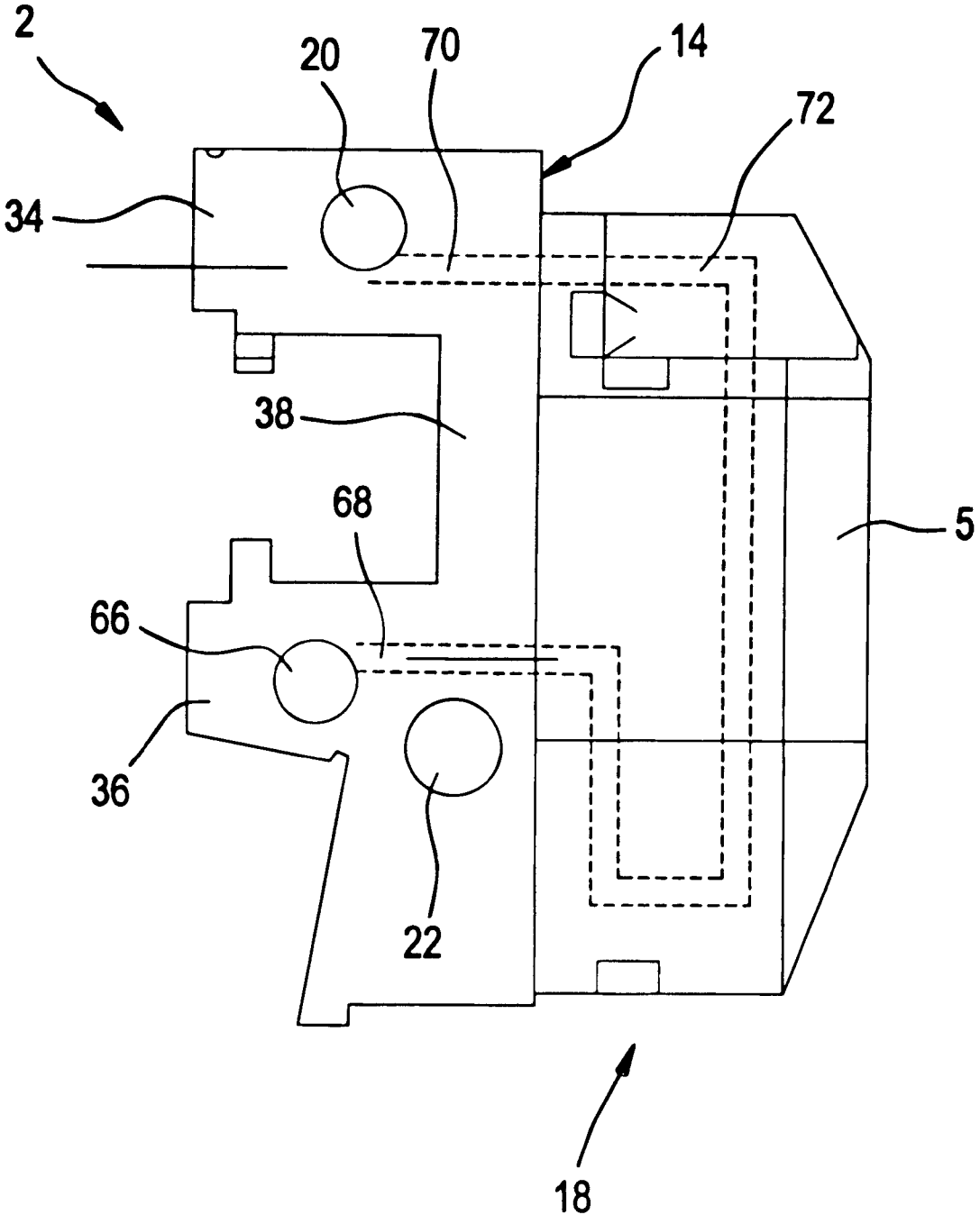
FIG. 7 is a sectional view of an alternative embodiment in accordance with the invention in which the application module has a circulation line and a distribution block with an additional recirculation canal.

An alternative embodiment of a device 65 in accordance with the invention for dispensing glue is shown in FIG. 7. Device 65 includes a main body 2 in the form of a distribution block (manifold) and a circulating application module 5 that, in this embodiment, has an electrically operable application valve. The main body 2 has a recirculation canal 66 running parallel to the fluid supply canals 20, 22. At right angles to the recirculation canal 66 is a recirculation bore 68 which communicates therewith and which ends in the mounting surface 14. If a number of application modules 5 are positioned adjacent to each other, several recirculation bores 68 are positioned parallel to each other in the main body 2. In the upper section 34 of the main body 2, a supply hole 70 communicates with the supply canal 20 and ends in the mounting surface 14. Fluid is introduced from the supply canal 20 through the supply hole 70 into a circulation line 72 in the application module 5. If the application valve (not shown) of the application module 5 is in the closed position, so that no fluid is escaping from the output orifice 18 of the application module 5, the fluid flowing through the circulation line 72 is conducted back through the recirculation hole 68 into the recirculation canal 66. If the application valve is in the open position and fluid is flowing from the output orifice 18, no fluid or only a small quantity flows through the recirculation hole 68 into the recirculation canal 66.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein we claim:

1. A device for dispensing first and second fluids, comprising:

a main body having first and second supply canals, said first supply canal supplying a flow of a first fluid and said second supply canal supplying a flow of a second fluid;

a first application module attached to said main body, said first application module having a first fluid passageway, a first discharge orifice in fluid communication with said first fluid passageway, and an electrically operable flow-control mechanism positioned in said first fluid passageway, said first fluid passageway coupled for fluid communication with said first supply canal and said electrically operable flow-control mechanism capable of selectively allowing and preventing flow of the first fluid through said first fluid passageway to said first discharge orifice; and a second application module attached to said main body, said second application module having a second fluid passageway, a second discharge orifice in fluid communication with said second fluid passageway, and a pneumatically operable flow-control mechanism positioned in said second fluid passageway, said second fluid passageway coupled for fluid communication with said second supply canal and said pneumatically operable flow-control mechanism capable of selectively allowing and preventing flow of the second fluid through said second fluid passageway to said second discharge orifice.

2. The device of claim 1, further comprising an electrical connector attached to said main body and an electrical line disposed within said main body, said electrical connector electrically coupled via said electrical line with said electrically operable flow-control mechanism.

3. The device of claim 1, wherein said main body includes a pressurized air canal capable of supplying a flow of pressurized gas for controlling said pneumatically operable flow-control mechanism.

4. A method of applying first and second fluids from a main body having first and second supply canals onto a substrate, comprising:

attaching a pneumatically operable application module to the main body and coupling a first flow passageway of the pneumatically operable application module in fluid communication with the first supply canal;

attaching an electrically operable application module to the main body and coupling a second flow passageway of the electrically operable application module in fluid communication with the second supply canal;

supplying a first fluid to the first supply canal;

supplying a second fluid to the second supply canal;

dispensing the first fluid from the first flow passageway onto the substrate with the pneumatically-operable application module; and dispensing the second fluid from the second flow passageway onto the substrate with the electrically-operable application module.

5. The method of claim 4 further comprising:

heating at least one of the first and second fluids before dispensing the first and second fluids.

6. The method of claim 5 further comprising:

heating the second fluid to a temperature that differs from the temperature of the first fluid.

7. The method of claim 4 further comprising:

pressurizing at least one of the first and second fluids before dispensing the first and second fluids.

8. The method of claim 7 further comprising:

pressurizing the second fluid to a pressure that differs from the pressure of the first fluid.

9. The method of claim 4 wherein the first and second fluids are liquids having different compositions.

* * * * *